US009352952B2

(12) United States Patent
Nicholls et al.

(10) Patent No.: US 9,352,952 B2
(45) Date of Patent: May 31, 2016

(54) FLUID PORTION DISPENSER

(75) Inventors: Ross William Nicholls, Maroubra (AU); Adam James Preston, Coogee (AU)

(73) Assignee: RAD I.P, PTY LIMITED, Botany (AU)

( * ) Notice: Subject to any disclaimer, the term of this patent is extended or adjusted under 35 U.S.C. 154(b) by 194 days.

(21) Appl. No.: 14/131,048

(22) PCT Filed: Jul. 3, 2012

(86) PCT No.: PCT/AU2012/000800

§ 371 (c)(1),
(2), (4) Date: Feb. 6, 2014

(87) PCT Pub. No.: WO2013/003900

PCT Pub. Date: Jan. 10, 2013

(65) Prior Publication Data

US 2014/0137982 A1 May 22, 2014

(30) Foreign Application Priority Data

Jul. 5, 2011 (AU) ..... 2011902666
Nov. 22, 2011 (AU) ..... 2011904867

(51) Int. Cl.
*B65B 1/30* (2006.01)
*B67D 7/30* (2010.01)
(Continued)

(52) U.S. Cl.
CPC ..... *B67D 7/302* (2013.01); *B67D 1/0007* (2013.01); *B67D 1/06* (2013.01); *B67D 1/10* (2013.01); *B67D 1/1236* (2013.01); *B67D 2001/082* (2013.01); *B67D 2001/0811* (2013.01)

(58) Field of Classification Search
CPC .. B67D 1/0005; B67D 1/0007; B67D 1/1236; B67D 1/0012; B67D 1/0019; B67D 7/30; B67D 7/302
USPC ..... 141/94, 311 R, 346, 351, 360, 362, 369, 141/370, 372, 373, 198
See application file for complete search history.

(56) References Cited

U.S. PATENT DOCUMENTS 3,265,099 A * 8/1966 Severino ..... G01F 23/241 137/392
4,202,387 A 5/1980 Upton
(Continued)

FOREIGN PATENT DOCUMENTS

FR 2505310 A1 11/1982
GB 2101089 A 1/1983
(Continued)

OTHER PUBLICATIONS

Partial Supplementary European Search Report in corresponding Application No. 12807508.2 issued Feb. 3, 2015.

*Primary Examiner* — Timothy L Maust
*Assistant Examiner* — Randall Gruby
(74) *Attorney, Agent, or Firm* — Bacon & Thomas, PLLC

(57) ABSTRACT

The present invention relates to dispensers of fluids such as liquids, powders or particulate solids and in particular, relates to apparatus to quickly, hygienically and accurately dispense predetermined measures of fluid products into a vessel according to the capacity of the vessel. In the preferred embodiment of the invention there is provided a fluid portion dispenser comprising at least one fluid reservoir, one or more nozzles, each of which being fixed to a work surface and having a nozzle outlet configured to dispense fluid from and a pump unit, connecting each reservoir to a nozzle and configured to pump fluid from each reservoir to a nozzle wherein each nozzle includes an activation mechanism, adapted to identify the capacity of a vessel in association with a nozzle outlet and activate the pump unit to dispense a portion of fluid from the nozzle outlet according to the capacity of the vessel identified.

13 Claims, 6 Drawing Sheets

(51) Int. Cl.

| | |
|---|---|
| ***B67D 1/00*** | (2006.01) |
| ***B67D 1/06*** | (2006.01) |
| ***B67D 1/10*** | (2006.01) |
| ***B67D 1/12*** | (2006.01) |
| *B67D 1/08* | (2006.01) |

(56) References Cited

U.S. PATENT DOCUMENTS

| | | | | | |
|---|---|---|---|---|---|
| 4,236,553 | A * | 12/1980 | Reichenberger | B67D 1/1238 | 141/198 |
| 4,440,200 | A * | 4/1984 | DeVale | G01F 13/006 | 141/198 |
| 4,446,896 | A * | 5/1984 | Campagna | G01F 23/2921 | 139/435.1 |
| 4,469,150 | A | 9/1984 | Grimaldi | | |
| 4,635,691 | A | 1/1987 | Hume | | |
| 5,491,333 | A * | 2/1996 | Skell | B67D 1/1236 | 141/95 |
| 5,566,732 | A * | 10/1996 | Nelson | G07F 13/025 | 141/351 |
| 5,575,405 | A * | 11/1996 | Stratton | B67D 1/0021 | 222/1 |
| 6,003,569 | A * | 12/1999 | Williams | C02F 1/008 | 141/18 |
| 6,100,518 | A * | 8/2000 | Miller | B67D 1/1236 | 141/1 |
| 7,353,850 | B2 * | 4/2008 | Greiwe | A47J 31/4482 | 141/198 |
| 7,637,205 | B2 * | 12/2009 | Greiwe | A47J 31/007 | 141/279 |
| 8,069,883 | B2 * | 12/2011 | Shiraishi | B67D 1/0027 | 141/351 |
| 8,511,348 | B2 * | 8/2013 | Lillard, Jr. | B67D 1/0888 | 141/2 |
| D689,329 | S * | 9/2013 | Nicholls | D23/238 | |
| 8,695,646 | B2 * | 4/2014 | Agam | A47J 31/44 | 141/198 |
| 8,757,222 | B2 * | 6/2014 | Rudick | B67D 1/0888 | 141/198 |
| 2007/0009365 | A1 * | 1/2007 | Litterst | B67D 1/102 | 417/44.1 |
| 2007/0125796 | A1 | 6/2007 | Cedrone et al. | | |
| 2008/0264092 | A1 * | 10/2008 | Chase | B67D 1/0858 | 62/389 |
| 2010/0175783 | A1 * | 7/2010 | Kim | F25D 29/00 | 141/198 |
| 2010/0242497 | A1 * | 9/2010 | Bertone | A23G 9/045 | 62/1 |

FOREIGN PATENT DOCUMENTS

| | | | |
|---|---|---|---|
| WO | WO2004024615 | A1 | 3/2004 |
| WO | WO/2009020256 | A1 | 2/2009 |
| WO | WO2009-059405 | A1 | 5/2009 |

* cited by examiner

FLUID PORTION DISPENSER

TECHNICAL FIELD

The present invention relates to dispensers of fluids such as liquids, powders or particulate solids and in particular, relates to apparatus to quickly, hygienically and accurately dispense predetermined measures of fluid products into a vessel according to the capacity of the vessel.

BACKGROUND TO THE INVENTION

Many applications exist where there is a need to accurately dispense fixed volumes or weights of fluid into a range of vessels. For example, in the catering and hospitality industries, accurately dispensing pre-determined portions of fluid product on demand can be of significant importance when repetitively preparing food and beverages. Within these industries, such dispensing mechanisms must remain as clean and hygienic as possible, particularly to meet certain regulatory requirements. Furthermore, in order to sustain a profitable business it is also important to avoid unnecessary wastage of food and beverage products and to dispense the portions as efficiently as possible.

Although prior art dispensing systems are available which perform adequately, improvements could be made in relation to the speed at which such systems operate. Improvements could also be made in the overall cleanliness and maintenance of such systems, in addition to the usability and convenience of operation inherent in such prior art.

For example with respect to the food industry, it is known to provide a hand pumped sauce dispenser on a tabletop which can be used by either kitchen staff or patrons directly. These hand pump dispensers simply hold a reservoir of sauce which can dispense a regular or repeatable volume of sauce on one full depression of the pumps drive lever. However, such dispensers suffer from hygiene and cleanliness issues and must be emptied and cleaned out regularly. It is also possible to over fill a vessel presented to a hand pump dispenser if the vessel is not capable of receiving the entire standard dose of sauce supplied by single actuation of the pump.

When the fluid to be dispensed is formed by pellets or powders a significant amount of handling work is required of kitchen staff. Staff must measure out required weights or volumes from bulk packaging stores, or need to individually open packaging used to protect single dose or single serve of fluid material. These approaches are relatively slow in operation and require a great deal of labour. Furthermore, single-dose packages have a higher environmental packaging cost, creating unnecessary amounts of waste material.

In café environments there is a need for baristas to regularly pour fixed volumes of refrigerated milk into vessels to be used in the preparation of beverages. Typically a milk container is manually removed by a barista from a refrigerator and the required volume of milk poured into a vessel, the vessel often having different dimensions according to the type of beverage being prepared. This approach makes it difficult to dispense fixed volumes of milk repeatedly and quickly and often clutters the baristas working surfaces. This approach also creates unnecessary wastage due to the packaging of the many milk containers which will be used in a day.

A number of past attempts have been made to resolve some of these issues by providing automated fluid dispensers. For example, U.S. Pat. No. 4,236,553 entitled "Beverage portion controller", in the name of Arthur Reichenberger, discloses an automated beverage dispensing system which dispenses liquid according to vessel capacity due to a probe being lifted vertically by the lip of a cup presented to the dispenser and dispensing the pre-determined volume of beverage according to the vertical displacement of the probe by the height of the cup. However, the apparatus is not only inconvenient and un-intuitive to use but also suffers from the drawback of increasing the chance of a user spilling a filled cup, particularly when being frequently operated such as in a busy café or fast food outlet. For example, when filling a cup with beverage a user must initially tilt the cup to hook the lip of the cup under the probe and lift the probe to activate the system, proving awkward. Once the cup has then had beverage dispensed into it, the filled cup is trapped between the probe and the base of the dispenser, by the probe exerting a force downwards on the lip of the cup. This would prove inconvenient to remove the cup and is likely to increase the chance of the filled cup being spilt due to the force of the probe on the lip and the likelihood that a cup would be tilted or knocked over during removal from the apparatus. Furthermore the hook of the probe on the lip of the cup would prove unhygienic, transmitting residue between cups presented to the apparatus, particularly when dispensing liquids such as milk.

Accordingly it would be useful to provide a fluid dispensing system that dispenses a portion of fluid according to the capacity of a vessel presented to the system which is intuitive and convenient to use and does not increase the risk of a user spilling the vessel's contents once filled. It would be advantageous to provide a dispensing apparatus that may be used reliably, frequently and dispenses at high speed, which minimizes wastage of dispensed product and packaging of the dispensed product. It would also be of advantage to provide a system that is hygienic and does not transfer dispensed product residue between vessels.

Accordingly, it would be useful to provide a solution that avoids or alleviates any of the disadvantages present in the prior art, or which provides an alternative to the prior art approaches.

SUMMARY OF THE INVENTION

According to one aspect of the invention there is provided a fluid portion dispenser comprising at least one fluid reservoir, one or more nozzles, each of which being fixed to a work surface and having a nozzle outlet configured to dispense fluid from and a pump unit, connecting each reservoir to a nozzle and configured to pump fluid from each reservoir to a nozzle wherein each nozzle includes an activation mechanism, adapted to identify the capacity of a vessel in association with a nozzle outlet and activate the pump unit to dispense a portion of fluid from the nozzle outlet according to the capacity of the vessel identified.

In the preferred embodiment, the capacity of a vessel is identified by measuring the diameter of the vessel. In such an embodiment, the activation mechanism comprises at least one pair of guide rails fixed in an angular relationship to one another and in relation to the nozzle, arranged to diverge away from the nozzle, and a linear displacement sensor located between each pair of guide rails, wherein the vessel when associated with a nozzle outlet is placed in contact with the pair of guide rails and the linear displacement sensor is displaced according to the diameter of the vessel.

In an alternative preferred embodiment, the activation mechanism comprises at least one pair of opposable jaws sprung towards each other, each jaw being rotatably connected around an axis and having a rotational displacement sensor affixed to the axis point, the vessel is when associated with the nozzle outlet forced the jaws apart and displaces each rotational displacement sensor according to the diameter of the vessel.

According to an additional variation of such an embodiment, the activation mechanism comprises at least one pair of guide rails fixed in an angular relationship to one another and in relation to the nozzle, arranged to diverge away from the nozzle, and an optical sensor, configured to transmit a signal and receive a response, wherein the vessel when associated with the nozzle outlet is placed in contact with the pair of guide rails and the optical sensor transmits and receives a signal, indicating the distance between the sensor and the vessel.

In an alternative embodiment, the capacity is identified by measuring the height of the lip of the vessel and the activation mechanism comprises a stop having a surface substantially perpendicular to the work surface and is located below the nozzle outlet and an actuator arm suspended below the nozzle outlet and being pivotally connected around an axis and having a rotational displacement sensor affixed at the axis point, wherein the vessel when associated with the nozzle outlet is in contact with the work surface and the stop, rotationally displacing the actuator arm according to the height of the lip of the vessel.

It is preferable that the invention includes a digital processor and memory, configured by programme instructions to control the pump unit and dispense the portion of fluid. In such an embodiment it is also preferable that the processor is able to be calibrated according to different vessel capacity measurements and record each in its memory.

According to another aspect of the invention, the reservoir is configured to adjust the temperature of the fluid.

Preferably the dispenser is configured such that the fluid dispensed is milk.

BRIEF DESCRIPTION OF THE DRAWINGS

Preferred embodiments of the invention will now be described, by way of example only, with reference to the accompanying drawings in which.

DETAILED DESCRIPTION OF THE DRAWINGS

Figure 1A:
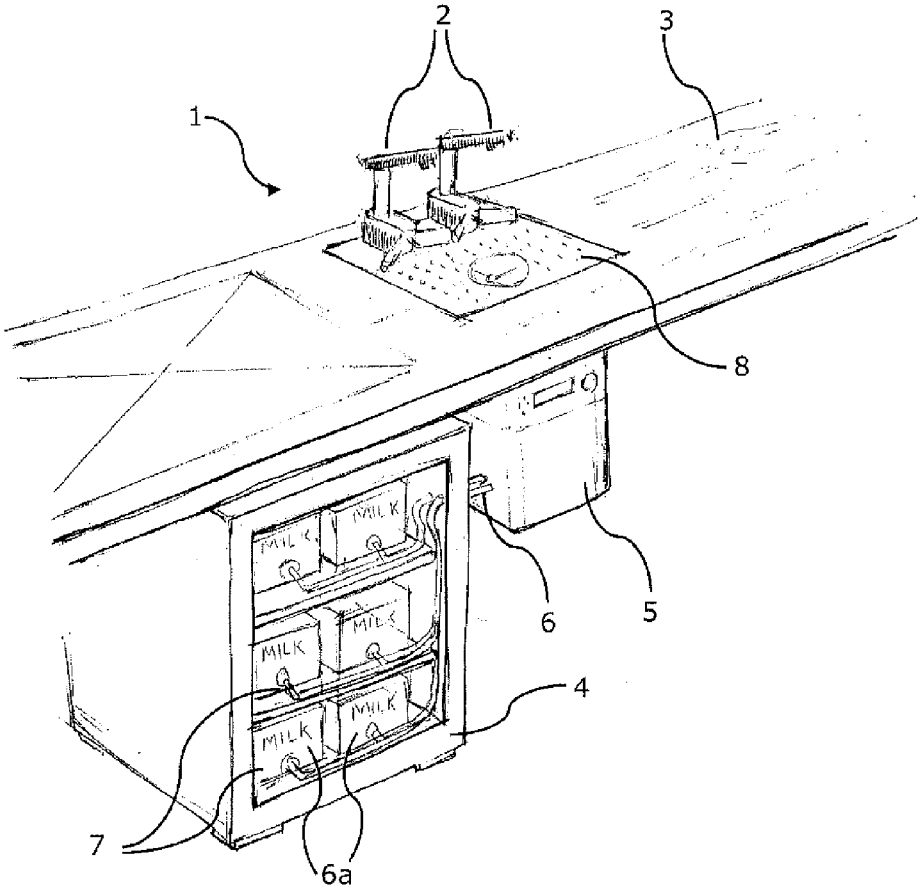
FIGS. 1A, 1B respectively show a perspective view and a detailed view of a dispenser provided in a preferred embodiment.

The present invention relates to a dispenser which provides predefined volumes or weights of fluids according to the capacity of a vessel presented to it. A preferred embodiment the present invention may be implemented as a milk dispenser which is installed within a work surface in a café or bar environment. In particular, reference throughout this specification will be made to the dispenser being implemented as a milk dispenser utilised within a café environment however, those skilled in the art will appreciate that other applications are envisioned for the invention and its use in a wide range of environments.

The present invention incorporates at least one outlet nozzle which is mounted to a work surface. An outlet nozzle comprises a conventional arrangement of components which can effectively dispense milk and other types of fluid. Such nozzles define an outlet port through which milk is dispensed and an inlet port connected close to the work surface to receive fluid. Those skilled in the art should appreciate that a wide range and variety of nozzles may be used with the invention. Furthermore, it will also be understood that the present invention may be implemented with various numbers of nozzles depending on its performance requirements. Reference in general throughout this specification will be made to the present invention including two nozzles mounted to a work surface.

In the preferred embodiment of the invention, the dispenser includes a dosage metering system. A dosage metering system is used to measure and otherwise control the volume, weight or amount of fluid dispensed to a vessel during a single operation. For example, in one embodiment the present invention may incorporate a load cell or similar weight measurement to weigh an empty vessel prior to fluid being dispensed. The empty vessel weight is then subtracted from the weight of the vessel during dispensing of fluid and the dispensing operation terminated when a pre-defined weight of fluid is present within the vessel. In other embodiments a flow rate sensor is integrated within each nozzle to measure the rate of delivery of liquid to a vessel. In conjunction with a timer, a flow rate sensor can be used to control the weight or volume of liquid dispensed in a single operation. Alternatively, where the flow rate of a liquid from a nozzle is reliably constant, a timer system can be used in conjunction to control the volumes or weights of liquid dispensed in a single operation.

A dispenser provided in accordance with the present invention also includes at least one activation system associated with one or more of the nozzles provided. Each activation system comprises the components of the invention which signal to initiate or cease the dispensing operation or cycle.

In a preferred embodiment an activation system is automatic and is able to identify the capacity of a vessel presented to a nozzle. Once a vessel is identified, the system retrieves information related to a predetermined portion, volume or weight of liquid which is associated with the identified vessel and controls the operation of the pump and nozzle to automatically deliver the predefined portion of liquid to the vessel.

In such embodiments, to operate the system, a user places a vessel which has been registered within the memory of the dispenser during a calibration process under a nozzle and the dispenser will automatically provide a portion of fluid to the dispenser. Such an automatic triggering system provides significant advantages over the prior art in terms of efficiency and usability. For example, in a café when a barista needs to fill a jug with milk, the jug may be placed under a nozzle to trigger the automatic filling of the jug with the appropriate volume of milk. Preferably such a system has little physical interaction with the vessel being filled, providing an easy to use apparatus that does not increase the risk of spilling the filled vessel due to forces being exerted on the vessel to retain it under the nozzle.

Preferably, the dispenser includes a digital processor and associated memory elements to control the operation of the dispenser pump and facilitate a calibration and registration process for each vessel that will be used with the system. Such a digital processor is loaded with executable instructions appropriate to the tasks required of it as will be appreciated by and well understood by those skilled in the art.

The dispenser provided by the present invention is installed in association with a work surface according to the location or environment in which the dispenser is used will dictate the form or configuration of such a work surface. For example, in a preferred embodiment where the invention is configured as a café milk dispenser, the dispenser would be installed on the serving counter or bench top of the café. This bench top may also need to host coffee making machines, food display cabinets, and cash register equipment for example. Those skilled in the art should appreciate that space on such work surfaces is at a premium and needs to be utilised efficiently to prevent clutter during periods of high activity.

In alternative embodiments other forms of work surface may be associated with the dispenser. For example, in other embodiments the dispenser may be provided as part of a self-service catering facility in a food service buffet. In such applications the invention may be used by buffet patrons to dispense themselves fixed or controlled volumes of beverages and other forms of fluids.

Preferably the dispenser also includes or is associated with a drain system. The drain system comprises a drip tray and drain located directly beneath the outlets of the nozzles.

A dispenser provided by the present invention includes at least one fluid reservoir which provides bulk storage of fluids to be dispensed. The arrangement and configuration of the reservoir is dictated by the type of fluid and application in which the invention is used. In a preferred embodiment a reservoir is arranged to receive a plurality of individual packages or cartons of fluid to be dispensed. In such applications each package or carton has an outlet linked to a manifold system which collects fluids from each of the containers into a single delivery line to the nozzles. For example, in such embodiments a reservoir formed from or capable of receiving a number of individual packages can engage with a manifold system. This manifold system preferably provides an inlet port or connector for each package associated with the reservoir and has an outlet port associated with or connected to a pump provided in accordance with the invention. The manifold system can therefore allow a reservoir to be provided with a variable overall capacity depending on the number of packages which are connected to the manifold.

In an alternative embodiment, a single carton or large bag may be stored in the reservoir to store the fluid to be dispensed. In further embodiments where powders or particulates are to be dispensed, a vat or hopper based system may provide a fluid reservoir. Those skilled in the art will appreciate that the applications in which the invention is employed will dictate the exact form and arrangement of the fluid reservoir or reservoirs required.

In a preferred embodiment where the fluid reservoir contains multiple fluid containers, the reservoir may also provide an angled or sloping support surface for each container. For example, in one embodiment a reservoir may be arranged with a cabinet configuration providing a series of trays or drawers, one on top of each other capable of receiving a flexible bladder containing fluid to be dispensed. The trays may preferably be angled or sloped so as to drain each fluid bladder to the front of the tray and to an associated connection with an inlet of the manifold system. In a further preferred embodiment this array of supporting trays may also have a substantially v-shaped angled form to drain all fluid contained within a bladder to a single central exit point adjacent to the bladder's connection to a manifold system inlet. This particular arrangement of supporting trays in a reservoir maximises the amount of fluid that can be drawn without any need for manual intervention to re-arrange any fluid packages.

In one embodiment where a reservoir is associated with a fluid delivery manifold system the manifold's inlets may incorporate a self-guiding or self-aligning connection system. This self-aligning connection system can be utilised to ensure a firm fluid-tight connection is provided between the manifold and a fluid package—thereby preventing leaks from occurring or contamination of any food based fluids.

In a preferred embodiment a self-guiding manifold inlet connection may incorporate a substantially conical guide surface provided adjacent to at least one engagement surface which has a form complimentary to a receiving fixture provided with the fluid packaging. In a further preferred embodiment a pair of complimentary engagement surfaces may be provided with the conical guide surface interposed between these surfaces. In such an embodiment the first engagement surface can be introduced into the fluid packaging and urged forward until the manifold connector's guide surface meets the packaging fixture. At this point the conical form or shape of the guide surface will automatically align and centre the manifold inlet connector—allowing it to be urged further into the packaging fixture and for the final exposed engagement surface to contact a further complimentary surface provided in the packaging. This arrangement of manifold inlet connector can therefore correctly and automatically align the connector with a complimentary fixture provided in the fluid packaging and provide a fluid-tight seal through the provision of two or potentially more engagement surfaces within the connector.

In a preferred embodiment where the invention is used to dispense milk, a fluid reservoir may also integrate or implement a refrigeration system. For example, in one such embodiment where a plurality of milk cartons are connected to nozzles by way of a manifold, these milk cartons may be located within a refrigerator which incorporates an outlet port for the manifold.

In yet other embodiments a fluid reservoir may be implemented which can apply a pre-treatment process to fluids prior to dispensing. For example, one embodiment a reservoir may include a heater system which may raise the temperature of fluids prior to reaching a nozzle. Those skilled in the art should appreciate that various additional sub-systems ranging from refrigeration, heating, homogenisation, mixing or a controlled introduction of further additives to the fluid may also be implemented in conjunction with a fluid reservoir if required. References to a fluid reservoir refrigerating fluids only throughout this specification should in no way be seen as limiting.

In some embodiments the present invention includes at least one pump to drive fluid from the reservoir to each nozzle. In a preferred embodiment a pump is an electrically powered liquid driving pump. A liquid pump is preferably connected to a manifold based fluid collection system. Alternatively a liquid pump could be connected to a single bulk package of fluid in other embodiments. However in an alternative embodiment the reservoir may be located in an elevated position in relation to each nozzle and provide fluid to the nozzles under the force of gravity, removing the necessity for a pump.

Preferably the dispenser is arranged to locate its reservoir and pump remote from the work surface in which an outlet nozzle or nozzles are installed. This arrangement of the dispenser ensures that a minimum amount of the work surface is used to site the components of the dispenser—leaving space free for the day to day operations and equipment of a café or other equivalent environment. In a further preferred embodiment, fluid reservoirs and pumps integrated within the dispenser may be located underneath a work surface approximately adjacent to any nozzles provided.

In embodiments where the nozzles are located in a position vertically above and displaced from the reservoir it will be appreciated that once the pump is deactivated a head of fluid will remain in the connecting conduits of the invention. The fluid remaining in the outlet nozzle and connecting tubing will therefore have a greater elevation head than any fluid located in a reservoir, causing this remaining fluid to drain back towards a reservoir under the action of gravity. In such embodiments the invention may also incorporate at least one flow control valve situated between a reservoir and a nozzle employed within the invention to prevent back flow of fluid from the nozzle and associated conduit under the action of gravity during idle periods.

In some embodiments a flow control valve may act as a forward flow control element, being towards each nozzle, provided by a non-return valve with a relatively low opening pressure (such as for example 0.007 bar) which allows fast forward flow of fluids during dispensing. This form of valve will impede the reverse flow of fluids at idle times by staying closed against the force of the head of fluid within the conduit and nozzle above the valve.

In a further preferred embodiment an alternative fluid control valve, being a high pressure reverse flow valve, is provided. A high pressure reverse flow control valve may be employed with an operational scheme that allows for the reversal of the pump's operation immediately after the end of a dispensing action. This valve will normally impede the flow of fluid in the direction from the nozzle to a reservoir unless the pressure of this fluid exceeds a minimum level—being the pressure applied by the pump when running in reverse. This will allow fluid to be pumped back into the reservoir when the pump is run in reverse but will impede fluid flowing in the same direction simply under the action of gravity an elevated head of fluid head above the pump and reservoir.

Those skilled in the art will appreciate that a number of different configurations of control valves may be provided in instances where a manifold system is associated with a reservoir having a number of fluid packages. In such embodiments a single forward flow valve and high pressure reverse flow valve assembly may potentially be located on the outlet of the manifold. Alternatively in other embodiments each manifold inlet may incorporate a single forward flow valve assembly with one or more of these outlets also incorporating a high pressure reverse flow valve assembly. Again, those skilled in the art should appreciate that both the forward flow and high pressure reverse flow valve assemblies may be implemented through separate valve assemblies—or alternatively by one single valve assembly if required.

The design and construction of such a manifold system can also be arranged to ensure that each fluid package is exhausted completely before its neighbouring adjacent package is used to dispense further fluid. For example, in some embodiments valves associates with the inlets of the manifold may be controlled so as to open only a controlled sequence starting from the lowest fluid package to finally the top most or highest package provided in association. with the reservoir.

In a preferred embodiment the dispenser may also include a connection to a water supply system. Preferably this water supply system can be adapted to deliver a pressurised supply of water to a pump integrated into the invention. This arrangement would allow the pump to dispense water from a nozzle.

A water supply connection provided to a pump may also be utilised in a shut-down flush and cleaning cycle operation. For example, in some embodiments after the closure of a food service or catering venue, a wash cycle may be completed to flush the fluid carrying components of the dispenser with cleaning water. Preferably in such embodiments water flushed through the standard dispensing channels and components of the dispenser will ultimately be delivered through a nozzle to be collected by a drainage tray.

Turning to the drawings, FIG. 1A shows a perspective view of a dispenser provided in accordance with a preferred embodiment of the invention. The dispenser 1 includes one or more outlet nozzles 2 which are mounted onto a work surface or counter 3. The outlet nozzles 2 are connected to a fluid reservoir, shown in this embodiment as refrigerator 4. The fluid reservoir implemented by the refrigerator 4 supplies milk to the nozzles 2 by way of a pumping unit 5. The pumping unit 5 is connected to the refrigerator 4 by a tubing manifold 6. Each of the inlets 6*a* of the manifold are in turn connected to a disposable package of milk 7. Underneath the outlet nozzles 2 there is provided a drip tray 8 which covers a drain (not shown).

Figure 1B:
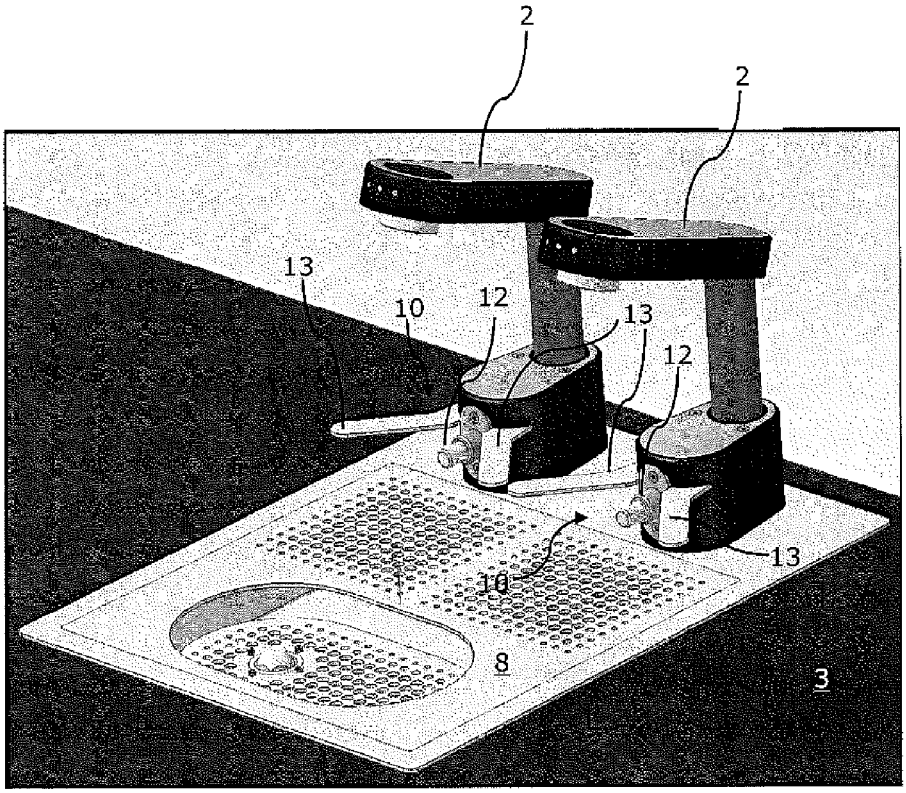

FIG. 1B shows a detailed view of FIG. 1A, illustrating two nozzles 2, each having an activation system 10, wherein triggering of the activation system 10 causes the pump to supply fluid to a nozzle 2. The activation system can be seen to include an actuator element 12 and at least two guide rails 13.

Figure 2:
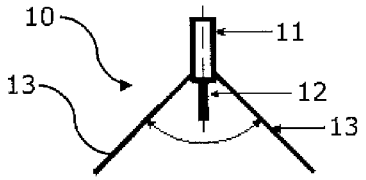
FIG. 2 provides a schematic component description of an activation system provided within the dispenser shown in FIGS. lA and 1B.

FIG. 2 shows a top view diagram of the activation system 10 in accordance with the previous two figures wherein the system includes at least one linear displacement sensor 11 fixed relative to the output of the nozzle and associated with a movable actuator 12. These components are situated at the intersection of at least two guide mils 13 which have a fixed angular relationship with respect to one another and the sensor 11.

Figures 3A, 3B, 3C:
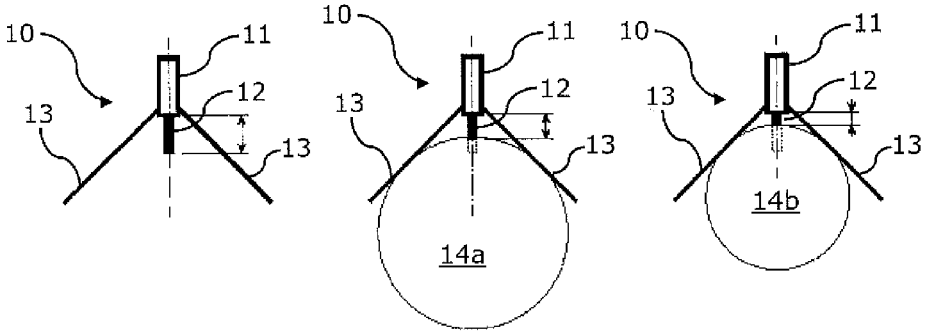
FIG. 3A-3C illustrates the activation system shown in FIG. 2 during operation.
Figure 4:
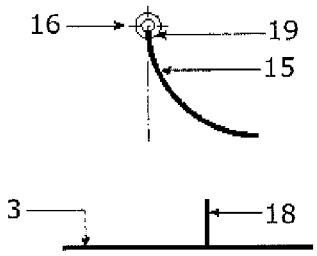
FIG. 4 provides a schematic component description of an alternative activation embodiment.

FIGS. 3A, 3B and 3C illustrate the operation of the actuation system shown in FIG. 2. FIG. 3A shows the system prior to the introduction of a vessel to a nozzle, FIG. 3B shows the displacement of the actuator 12 as a first vessel 14*a* is urged by a user between the guide rails 13 and FIG. 3C shows an alternative vessel 14*b* placed between the guide rails. As can be seen from FIGS. 3B-3C the actuator 12 is depressed towards the sensor 11 by the walls of the vessel 14 until the vessel is in contact with both of the adjacent guide rails 13. The distance by which the actuator is depressed can be seen to vary according to the diameter of the vessel; FIG. 3B illustrating a first displacement distance by a larger vessel 14*a* and FIG. 3C illustrating a second larger distance by a smaller vessel 14*b*. According to the, diameter of the vessel, the guide rails prevent the vessel from being introduced towards the nozzle and sensor 11 at a certain point, therefore associating a displacement of the actuator with a specific vessel diameter and effectively indicating the capacity of the vessel to the system. Accordingly, the processor is triggered to activate the pump to deliver the predetermined portion of fluid considered appropriate for that capacity of vessel, according to the vessel calibration data recorded in the system.

In an alternative embodiment (not shown) the activation system 10 is provided by at least two guide rails 13, arranged similarly in relation to the nozzle as shown in FIGS. 2-3, which are pivotably connected at an end to the nozzle and sprung towards one another below the nozzle, requiring a user to urge the guide rails apart with the side-walls of a vessel to activate the system. In such an embodiment a rotational displacement sensor is also associated with each guide rail at its pivot point and which measures the rotational displacement of each guide rail when a vessel is urged between the guide rails under the nozzle. Similarly to above, the rotational displacement measurement indicates to the processor the diameter of the vessel that has been presented to the system and triggers the processor to activate the pump to deliver the predefined portion size for that diameter, and capacity, of vessel.

In a further alternative embodiment (not shown) the activation system is provided in a similar arrangement to that shown in FIGS. 2-3, wherein an optical sensor, such as an infra-red sensor or the like, is employed in place of the linear displacement sensor 11 and actuator 12. In such an arrangement, when the vessel is placed between the guide rails 13, the optical sensor detects the distance between its fixed position and the vessel and similarly indicates the diameter of the vessel to the processor and the consequently, the portion of fluid that should be automatically dispensed.

FIGS. 4 and 5A-5C illustrate a side view diagram of an alternative embodiment of the activation system 10 having a pivotable actuator arm 15, rotatable about an axis 16, an angular displacement sensor 19 connected to the arm at the axis and a stop element 18, fixed in relation to the nozzle and having a surface perpendicular to the work surface 3.

Figure 5A:
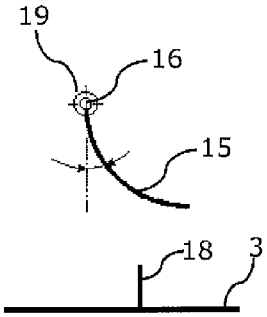
FIG. 5A-5C illustrates the activation system shown in FIG. 4 during operation.
Figure 5B:
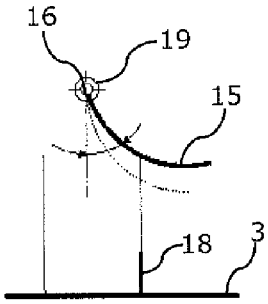
Figure 5C:
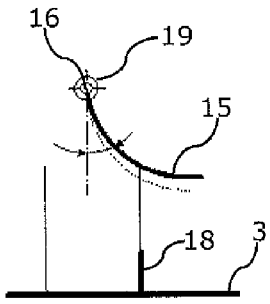

As can be seen from FIG. 5A-5C, when a vessel is introduced to the activation system, the actuator arm 15 pivots upwards due to contact with the lip of the vessel. A single guide rail 18 is provided underneath the movable arm to halt the progress of a vessel being introduced. As can be seen from FIGS. 5B and 5C, the actuator is rotatably displaced according to the height of the lip of a vessel and the angular displacement sensor 19 measures a different displacement according to the height of the vessel. Similar to the previous embodiment described in relation to FIGS. 2-3, the displacement measurement recorded by the sensor 19 indicates to the processor the height and effective capacity of the vessel, following which the processor may activate the pump to deliver the prescribed portion of fluid for that capacity of vessel, in accordance with the calibrated vessel capacity data recorded in the system.

Figure 6:
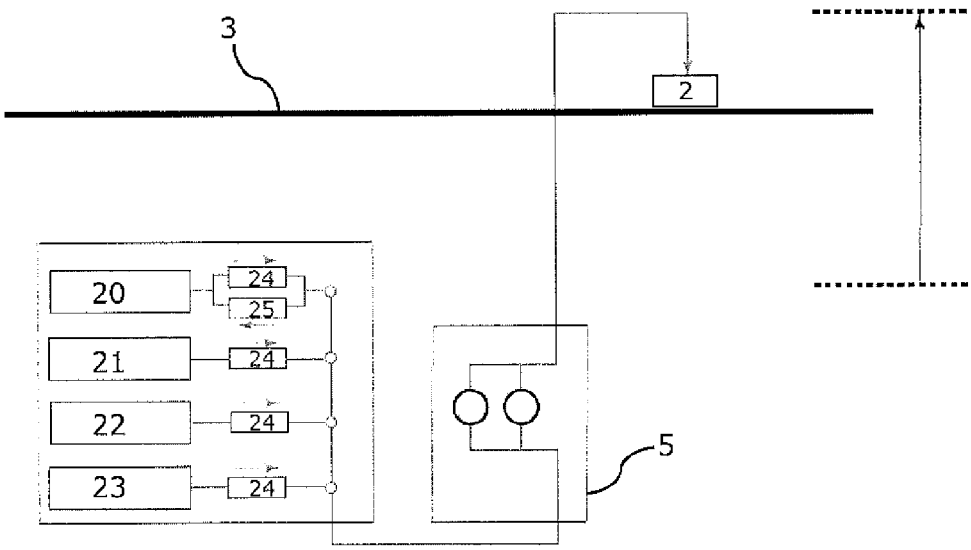
FIG. 6 illustrates fluid flow paths and directions implemented in accordance with yet another embodiment of the invention.

FIG. 6 illustrates fluid flow paths and directions provided in accordance with yet another embodiment of the invention which integrates a series of flow control valves. As can be seen from FIG. 6, an elevation head is formed between an outlet nozzle and the reservoir provided by the refrigeration unit illustrated. The refrigeration unit contains a series of fluid bladders linked to a manifold system which is in turn connected to a pair of pumps.

In the embodiment shown with respect to FIG. 6, the uppermost fluid containing bladder 20 is connected to a manifold inlet which has a pair of associated separate fluid control valves, valve 24 and valve 25. In the embodiment shown, valve 24 is formed by a forward flow valve as indicated by the directional arrows presented, whereas valve 25 provides a high pressure reverse flow valve. Conversely, each of bladders 21-23 are linked to the manifold valve inlets which incorporate only forward flow valve 24 arrangements.

As can be seen from FIG. 6, each of the forward flow valve 24 prevents backflow of fluid into each of bladders 20-23 under the pressure of the elevation head. Conversely, valve 25 will allow the fluid supply conduit shown to be drained when the pumps are run in reverse. The reverse activation of these pumps provides the fluid with sufficient pressure to overcome the resistance of the high pressure reverse flow valve 25 and returns it return fluid to bladder 20.

Figure 7:
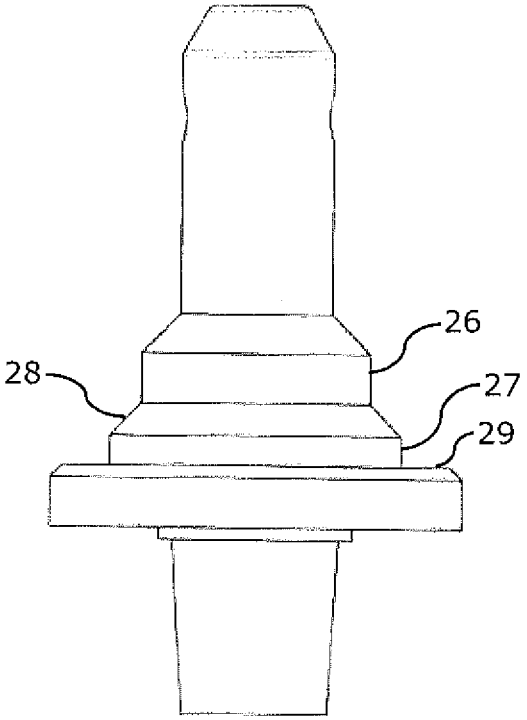
FIG. 7 shows a side view of a manifold inlet connector provided in accordance with another embodiment of the invention.

FIG. 7 shows a side view of a manifold inlet connector provided in accordance with yet another embodiment of the present invention.

As can be seen from FIG. 7, the manifold inlet connector illustrated includes a pair of complimentary lateral engagement surfaces 26, 27 provided above and below a conical guide surface 28. In use the upper free end of the connector is urged into a complimentary fixture of a fluid package with the upper complimentary engagement surface 26 sliding through a channel formed in this fixture (not shown). Once the connector's guide surface 28 meets the packaging the connector automatically aligns itself through the action of the conical guide surface as the connector is urged further into the packaging. Finally the connector comes to rest engaged with the packaging fixture with both the upper 26 and lower 27 complimentary engagement surfaces engaged with the fixture in addition to a further exterior transverse engagement surface 29 abutting the face of the packaging fitment. This arrangement of elements within the connector ensures that it is automatically aligned correctly with the complimentary portions of the fluid packaging—thereby allowing the complimentary engagement surfaces it provides to form an effective fluid tight seal.

It will be apparent that obvious variations or modifications may be made which are in accordance with the spirit of the invention and which are intended to be part of the invention, and any such obvious variations or modifications are therefore within the scope of the invention. Although the invention is described above with reference to specific embodiments, it will be appreciated by those skilled in the art that it is not limited to those embodiments, but may be embodied in many other forms.

In this specification, unless the context clearly indicates otherwise, the term "comprising" has the non-exclusive meaning of the word, in the sense of "including at least" rather than the exclusive meaning in the sense of "consisting only of". The same applies with corresponding grammatical changes to other forms of the word such as "comprise", "comprises" and so on.

It will be apparent that obvious variations or modifications may be made which are in accordance with the spirit of the invention and which are intended to be part of the invention. Although the invention is described above with reference to specific embodiments, it will be appreciated by those skilled in the art that it is not limited to those embodiments and may be embodied in many other forms.

INDUSTRIAL APPLICABILITY

The invention can be utilised in fluid dispensing operations, particularly in the catering and scientific research industries.

The invention claimed is:

1. A fluid portion dispenser for dispensing fluid into a vessel, the fluid portion dispenser comprising:

at least one fluid reservoir containing fluid;

a nozzle configured to dispense the fluid therefrom;

a pump unit for pumping the fluid from the at least one fluid reservoir to the fluid nozzle; and an activation mechanism for operating the fluid portion dispenser, the activation mechanism comprising a sensor which is configured to measure distance, and a pair of guides affixed relative to the sensor and arranged diverging away from the sensor, whereby placing a vessel against both guides allows the sensor to measure a distance between the vessel and the sensor, thereby causing the fluid portion dispenser to determine a volume of fluid to dispense, and dispensing the volume of fluid from the nozzle.

2. The fluid portion dispenser according to claim 1, wherein the sensor is a linear displacement sensor having a displaceable portion arranged to abut and be displaced by the vessel, thereby causing the sensor to measure the distance between the vessel and the sensor.

3. The fluid portion dispenser according to claim 2, wherein the sensor is an optical sensor.

4. The fluid portion dispenser according to claim 2, wherein the nozzle is adapted to be affixed to a surface, and the pair of guides are fixed relative to the surface.

5. The fluid portion dispenser according to claim 2, wherein the sensor is affixed relative to the nozzle.

6. The fluid portion dispenser according to claim 1, wherein the sensor is an optical sensor.

7. The fluid portion dispenser according to claim 1, wherein the nozzle is adapted to be affixed to a surface, and the pair of guides are fixed relative to the surface.

8. The fluid portion dispenser according to claim 1, wherein the sensor is affixed relative to the nozzle.

9. The fluid portion dispenser according to claim 1, wherein the nozzle is adapted to be affixed to a surface, and the pair of guides are fixed relative to the surface.

10. The fluid portion dispenser according to claim 1, wherein the sensor is affixed relative to the nozzle.

11. The fluid portion dispenser according to claim 1, further comprising a processor and a memory for storing fluid volumes corresponding with vessel dimensions, and wherein responsive to the processor receiving a vessel dimension measurement from the sensor, the processor consults the memory for a corresponding volume of fluid and operates the pump to dispense the volume of fluid from the nozzle.

12. The fluid portion dispenser according to claim 1, further comprising temperature control means for adjusting temperature of the fluid in the at least one fluid reservoir.

13. The fluid portion dispenser according to claim 1, wherein the fluid is milk and the nozzle is adapted to dispense the milk.

* * * * *